US012559921B2

(12) United States Patent
Ayala et al.

(10) Patent No.: US 12,559,921 B2
(45) Date of Patent: Feb. 24, 2026

(54) RINSING LAVATORY

(71) Applicant: Kohler Co., Kohler, WI (US)

(72) Inventors: Diego Alejandro Cuervo Ayala, Sheboygan, WI (US); Tyler Doro, Grafton, WI (US)

(73) Assignee: Kohler Co., Kohler, WI (US)

( * ) Notice: Subject to any disclaimer, the term of this patent is extended or adjusted under 35 U.S.C. 154(b) by 231 days.

(21) Appl. No.: 18/236,465

(22) Filed: Aug. 22, 2023

(65) Prior Publication Data

US 2024/0068212 A1 Feb. 29, 2024

Related U.S. Application Data

(60) Provisional application No. 63/402,649, filed on Aug. 31, 2022.

(51) Int. Cl.

| | |
|---|---|
| ***E03C 1/048*** | (2006.01) |
| ***E03C 1/04*** | (2006.01) |
| ***E03C 1/18*** | (2006.01) |

(52) U.S. Cl.

CPC ..... *E03C 1/048* (2013.01); *E03C 1/0404* (2013.01); *E03C 1/18* (2013.01)

(58) Field of Classification Search

CPC ..... E03C 1/048; E03C 1/0404; E03C 1/18

USPC ..... 4/619

See application file for complete search history.

(56) References Cited

U.S. PATENT DOCUMENTS

| | | | | |
|---|---|---|---|---|
| 4,231,123 | A * | 11/1980 | Cheng | E03C 1/2306 4/651 |
| 7,155,759 | B2 | 1/2007 | Milne | |
| 7,461,419 | B2 | 12/2008 | Milne | |
| 11,332,914 | B2 | 5/2022 | Armbruster et al. | |
| 11,332,915 | B2 | 5/2022 | Song et al. | |
| 2007/0011806 | A1 | 1/2007 | Knowlton | |
| 2009/0249541 | A1* | 10/2009 | Aykens | E03C 1/18 4/629 |
| 2016/0069054 | A1 | 3/2016 | Yu | |
| 2016/0289933 | A1 | 10/2016 | Williams, III | |
| 2019/0170371 | A1* | 6/2019 | Johnson | F24D 19/1051 |
| 2020/0284003 | A1* | 9/2020 | Armbruster | E03C 1/048 |
| 2020/0362547 | A1 | 11/2020 | Glivar | |
| 2021/0404157 | A1* | 12/2021 | Torres | E03C 1/048 |
| 2022/0025620 | A1* | 1/2022 | Eilmus | E03C 1/046 |
| 2024/0083771 | A1* | 3/2024 | Meier | C02F 1/003 |

FOREIGN PATENT DOCUMENTS

| | | | |
|---|---|---|---|
| CN | 204080968 | U | 1/2015 |
| CN | 205822355 | U | 12/2016 |
| CN | 109914535 | A | 6/2019 |

(Continued)

*Primary Examiner* — Huyen D Le

(74) *Attorney, Agent, or Firm* — Lempia Summerfield Katz LLC

(57) ABSTRACT

A rinsing lavatory includes a basin, at least one tube, and at least one valve. The basin includes at least a first side and a second side. The at least one tube connects a water supply to a first plurality of nozzles on the first side of the basin and a second plurality of nozzles on a second side of the basin. The at least one valve is configured to open the first plurality of nozzles or the second plurality of nozzles to provide rinsing water to the first side of the basin or the second side of the basin in response to an input signal.

18 Claims, 12 Drawing Sheets

(56) References Cited

FOREIGN PATENT DOCUMENTS

| | | | |
|---|---|---|---|
| EP | 3222365 | A1 | 9/2017 |
| EP | 3978694 | A1 | 4/2022 |
| WO | 2005054590 | A1 | 6/2005 |
| WO | 2018208261 | A3 | 1/2019 |
| WO | 2022013096 | A1 | 1/2022 |

* cited by examiner

RINSING LAVATORY

This application claims priority benefit of U.S. Provisional Application No. 63/402,649 (010222-22051A-US) filed Aug. 31, 2022, which is hereby incorporated by reference in its entirety.

FIELD

The present application relates to a rinsing system for the sides of a lavatory.

BACKGROUND

A washbowl or a basin may be equipped with a faucet for providing water to the basin and a drain for emptying water from the basin. Generally, the water may be directed by the user (e.g., manually or with a cloth) to wash the sides of the basin. Some uses of the basin may result in substances being left on the sides of the basin. These uses may include brushing teeth, shaving, or other hygiene acts. When hair clippings, toothpaste, or other substances are left on the sides of the basin, it may be difficult for the user to wash the sides of the basin.

BRIEF DESCRIPTION OF THE DRAWINGS

Exemplary embodiments are described herein with reference to the following drawings, according to an exemplary embodiment.

DETAILED DESCRIPTION

Figure 1:
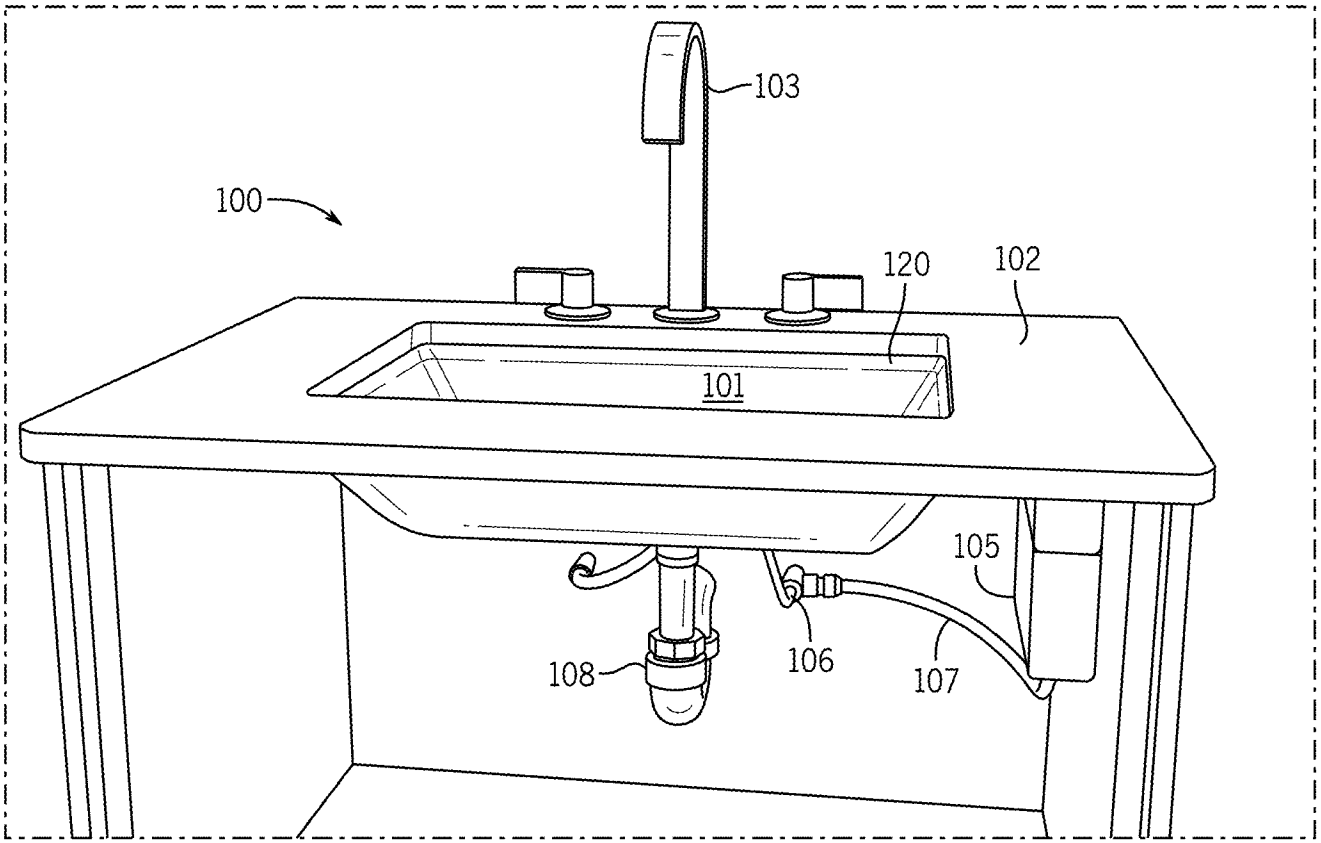
FIG. 1 illustrates a rinsing lavatory.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

FIG. 1 illustrates a rinsing lavatory 100 including a basin 101, a countertop 102, a faucet 103, a water treatment infuser 105, a supply line 107, a connector 106, and a drain 108. Additional, different, or fewer components may be included.

The basin 101 may have a variety of shapes. When the basin 101 is rectangular (as shown in the Figures), square, or another polygon, the basin 101 includes multiple sides. Polygons include at least a first side, a second side, and a third side, and often include four or more sides. Other shapes for the basin 101 may include a rounded rectangular shape. Alternatively, the basin 101 may include a shape without multiple sides such as an oval or a circle. Other shapes are possible.

For example, a rectangular basin 101 may include a set of nozzles on each of four sides that are individually controlled at each set. A separate water supply line and valve may connect each of the sets of nozzles to the water treatment infuser 105. Additional features may be created within each set. Such features may include oscillations, waterfalls, patterns, sweeping patterns of water flows from the nozzles. Any combinations of these may be used.

Figure 2:
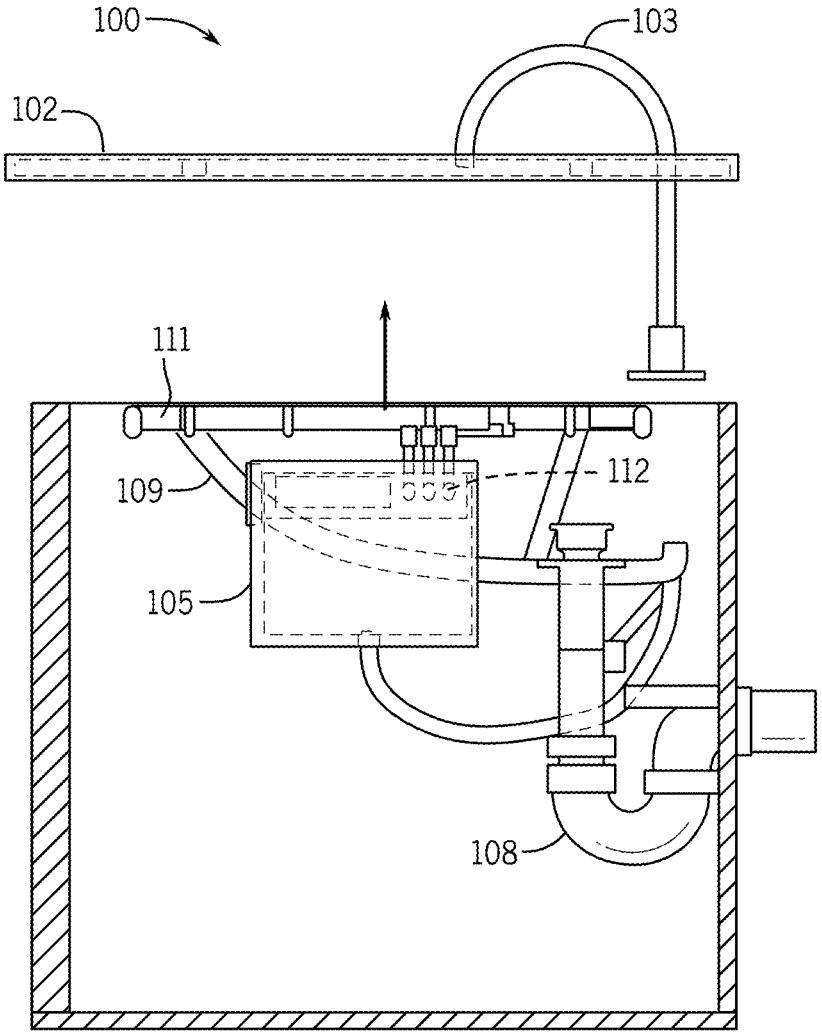
FIG. 2 illustrates a side view of the rinsing lavatory of claim 1.

FIG. 2 illustrates a side view of the rinsing lavatory 100 with an exploded view of the countertop 102 revealing a water delivery system 111. The water delivery system 111 may be integrated with or otherwise coupled the basin 101 and covered by the countertop 102. A support member may be coupled to the basin 101 and support the water delivery system 111 and a predetermined distance above the basin 101 and/or a predetermined distance below the countertop 102.

The countertop 102 may rest above the basin 101. The countertop 102 may be adjacent to and in contact with the basin 101. As discussed in more detail below, a water delivery system including multiple nozzles may dispense water from a location in a gap between the basin 101 and the countertop 102. The water delivery system may be located on multiple sides of the basin 101. The water rinses, cleans, and/or disinfects the sidewalls of the basin 101.

The water treatment infuser device 105 is connected to the water supply and at least one tube of the water delivery system. The water treatment device 105 may include an ozone generator or an electrolyzed water generator, as discussed in more detail below. The water treatment device 105 may include a venturi configured to induce a treatment additive into the water supply. The venturi may be fluidly coupled to a tank that houses the additive. Alternatively, the water treatment device 105 may include a chemical (e.g., hydrogen peroxide) additive.

The basin 101 may include a user input 120 (e.g., button, lever, capacitive switch, touchscreen, proximity sensor, gesture sensor, touch sensor, or other device). The user input 120 may receive one or more instructions from the user that trigger operation of the water treatment device 105 and/or the water delivery system. The instructions may be resolved and commands issued by a controller. Alternatively, the user input 120 may be directly electrically coupled to a pump, a power supply, a motor, or another device for operating the water treatment device 105 and/or the water delivery system. Alternatively, the rinse cycle may be initiated by the controller 200 when the user leaves (e.g., walks away from) the lavatory based on the proximity sensor.

Figure 3A:
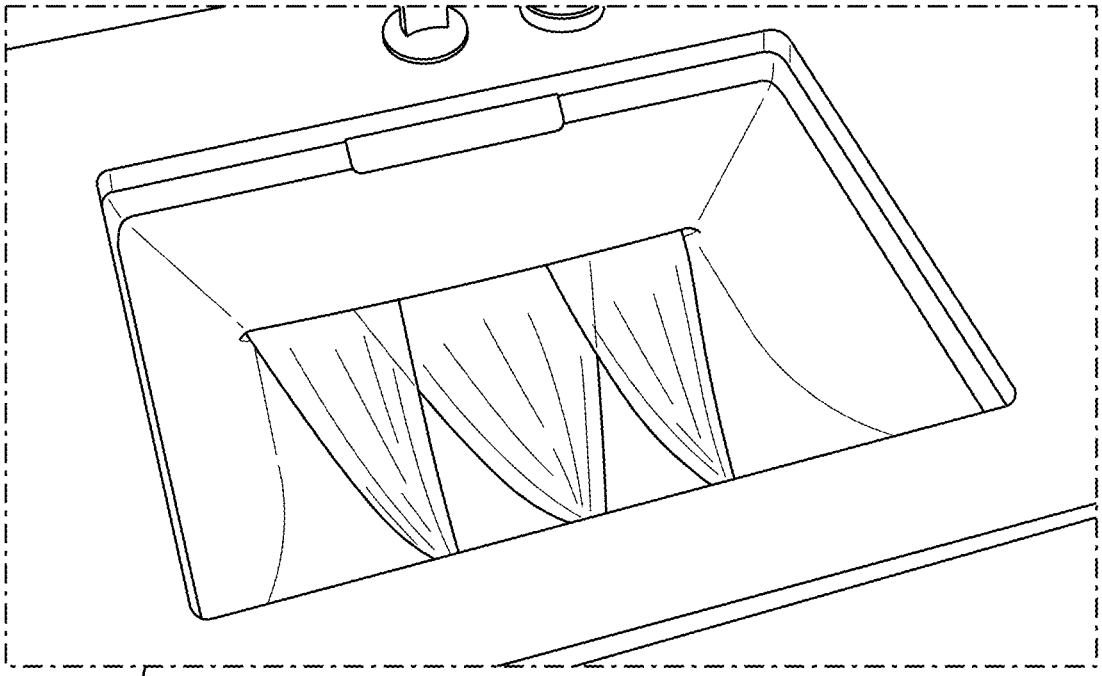
FIGS. 3A-E illustrates example water patterns for the rinsing lavatory.
Figure 3B:
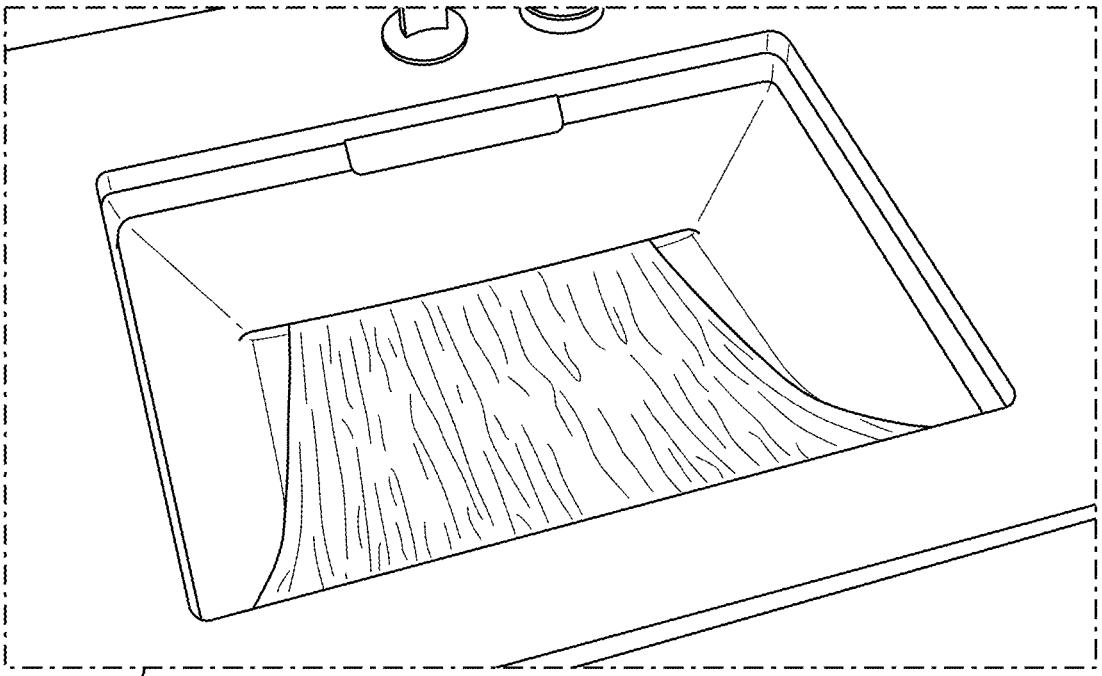
Figure 3C:
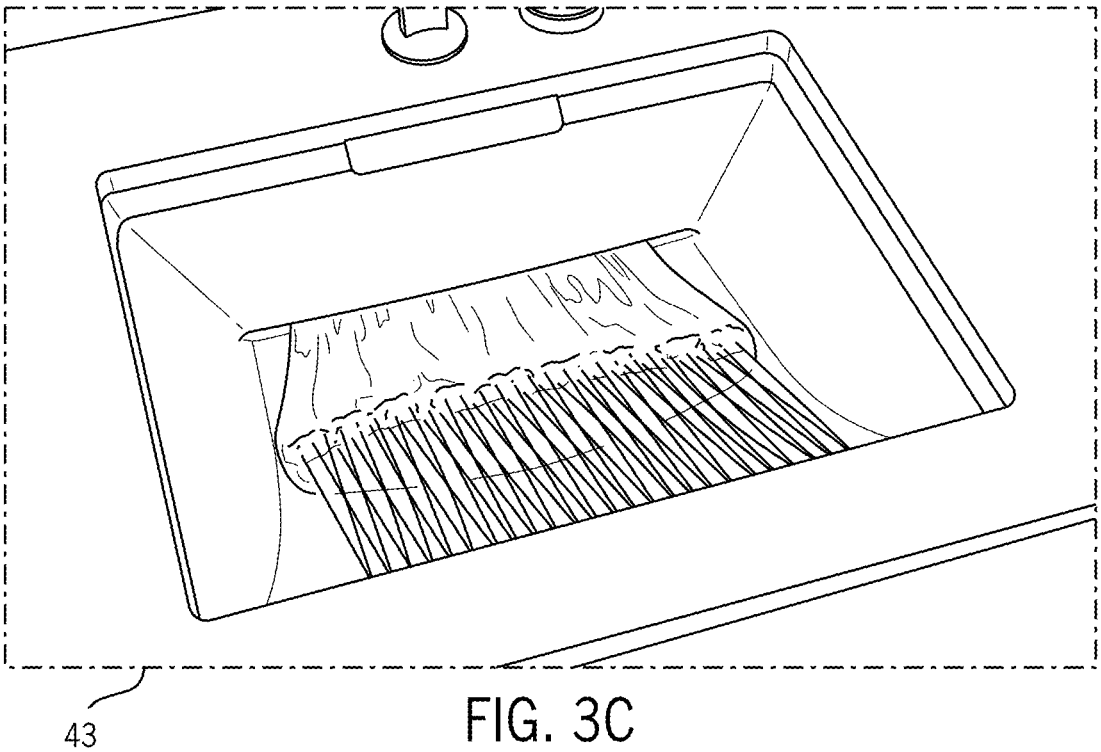
Figure 3D:
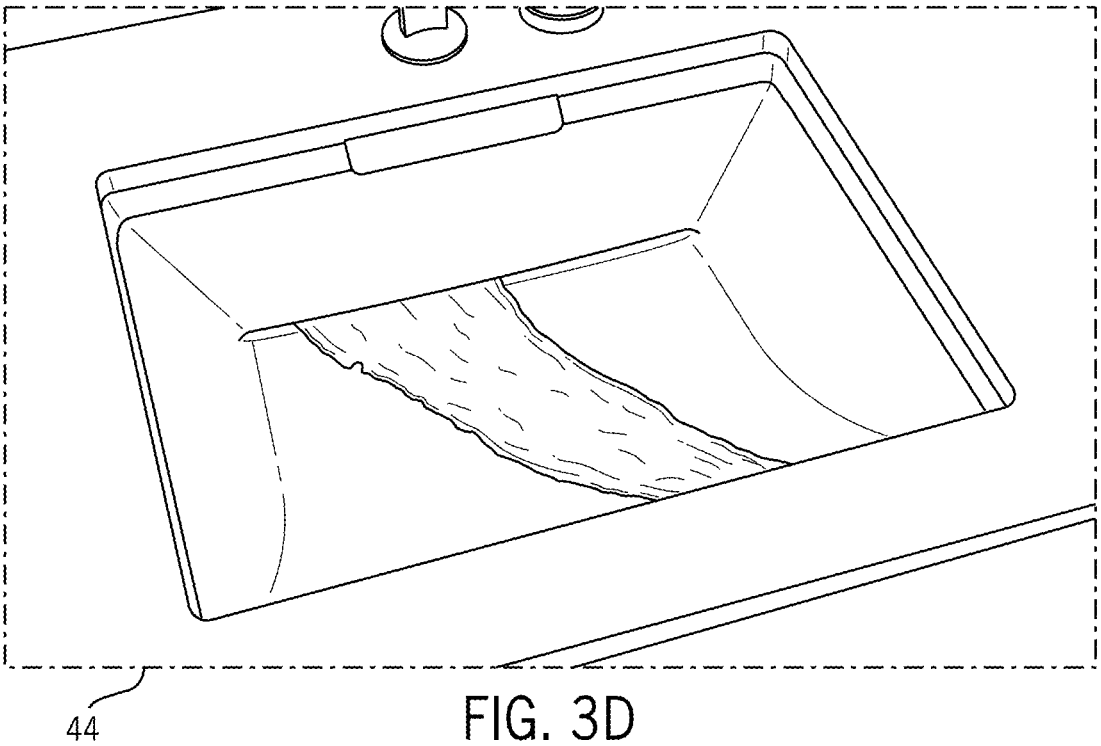
Figure 3E:
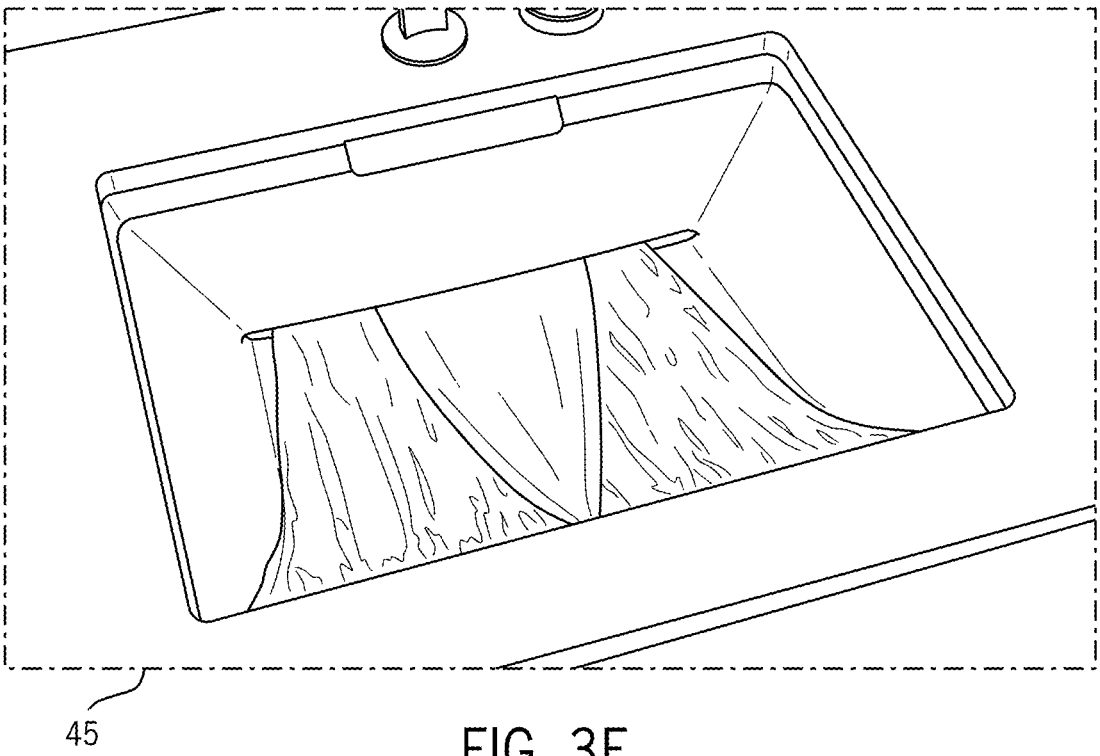

FIGS. 3A-E illustrates an oscillation pattern 41 in FIG. 3A, a waterfall pattern 42 in FIG. 3B, a discontinuous pattern 43 in FIG. 3C, a sweep pattern 44 in FIG. 3D, and a combination oscillation and waterfall pattern 45 in FIG. 3E. In the oscillation pattern 41, the water moves back and forth across the side of the basin 101 from multiple sources and at a narrow angle (e.g., less than 90 degrees). In the waterfall pattern 42, the sheet of water appears continuous and constant along the side of the basin 101. In the discontinuous pattern 43, the water is discontinuous and constant along the side of the basin 101. In the sweeping pattern 44, the water moves back and forth across the side of the basin from a single source at a wide angle (e.g., greater than 90 degrees). The combination oscillation and waterfall pattern 45 both the oscillations and waterfall are used together.

Figure 4:
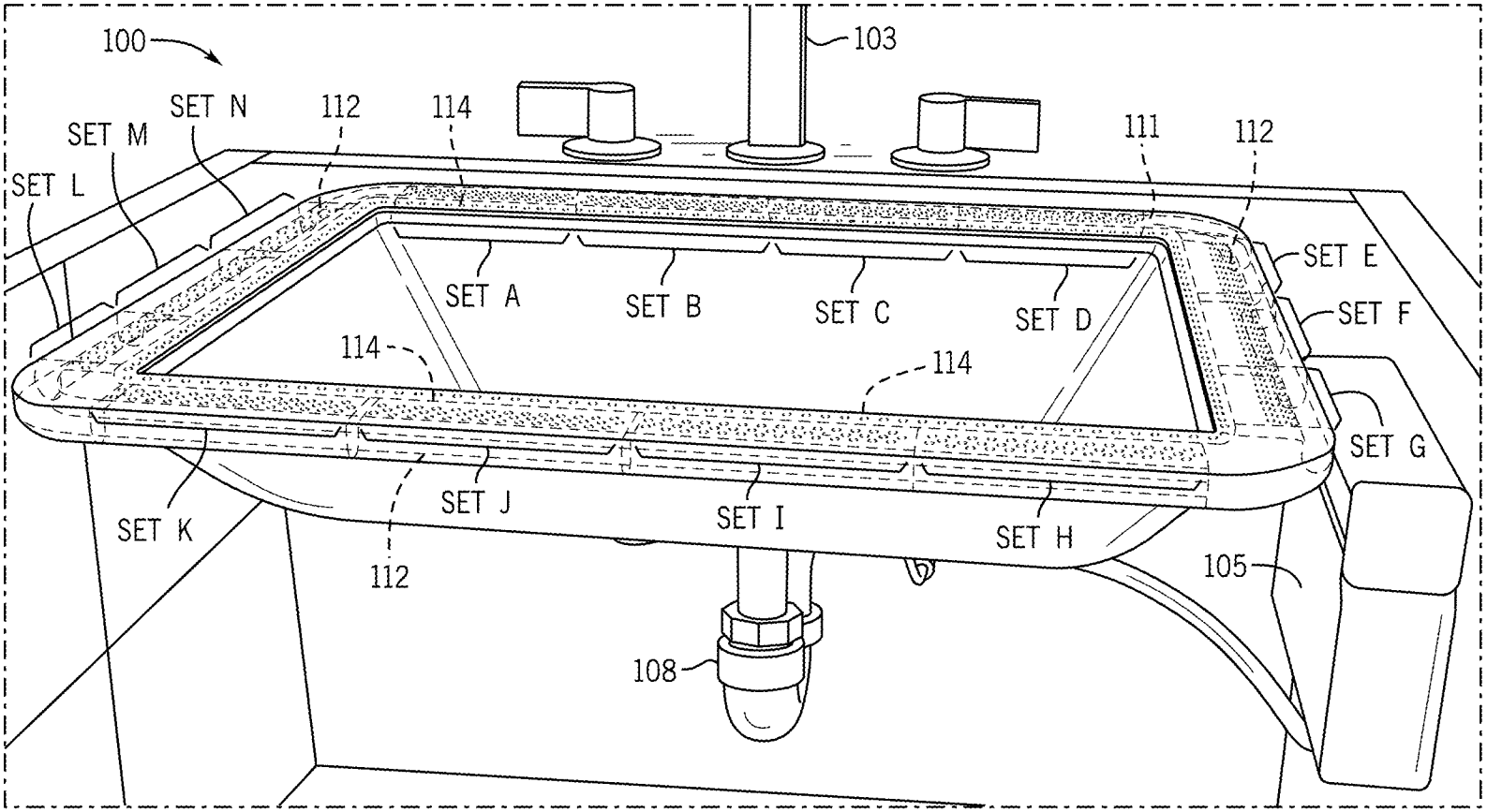
FIG. 4 illustrates a set of nozzles for the rinsing lavatory.
Figure 5:
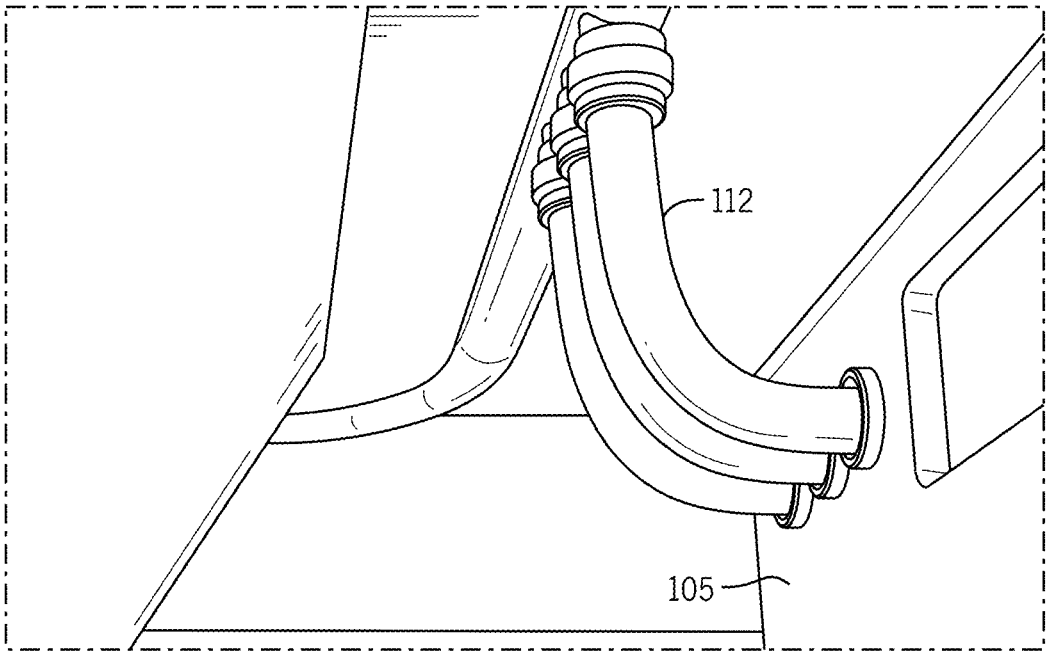
FIG. 5 illustrates supply lines for the nozzles.

FIG. 4 illustrates a more detailed view of the water delivery system 111 including at least one set of nozzles 114. Any number of nozzles may be used. As illustrated, more than 10 nozzles are provided at each side of the basin 101. When the basin 101 is rounds or oval, one or more nozzles may be provided along the circumference at a predetermined angular interval such as 5 degrees, 10 degrees, or another value less than 90 degrees. In the example illustrate, the back side of the basin 101 includes four sets of nozzles (set A, B, C, D), the front side of the basin 101 includes four sets of nozzles (set H, I, J, K), the left side of the basin 101 includes three sets of nozzles (set L, M, N), and the right side of the basin 101 includes three sets of nozzles (set E, F, G). FIG. 5 illustrates supply lines 112 for the nozzles and coupled to the water treatment infuser 105.

The water delivery system 111 may provide water to the sides of the lavatory 100 using a variety of techniques. In one example, the water delivery system 111 includes a series of tubes or supply lines 112 that track the perimeter of the basin 101. Each of the supply lines 112 may be associated with a different section of the basin 101. For example, each of the supply lines 112 may include nozzles on a predetermined section of the basin 101.

The nozzles may be sectioned. Each section may be supplied by a different one of the supply lines 112. In another example, a series of valves may operate the nozzles in sections. For example, a supply line 112 may include one or more valves along the supply line 112 which may be opened or closed (e.g., by respective solenoids) to define different sets of nozzles that dispense water at different times. In another example, the supply line 112 may branch out into multiple sections and a valve may selectively divert water to a particular branch or multiple branches. One or more valves may be configured to open the plurality of nozzles associated with a first side of the basin 101 and/or the second plurality of nozzles associated with a second side of the basin 101 and/or the third plurality of nozzles associated with a third side of the basin 101 and/or the fourth plurality of nozzles associated with a fourth side of the basin 101 in order to provide rinsing water to one or more selected side of the basin 101 in response to an input signal.

Figure 6:
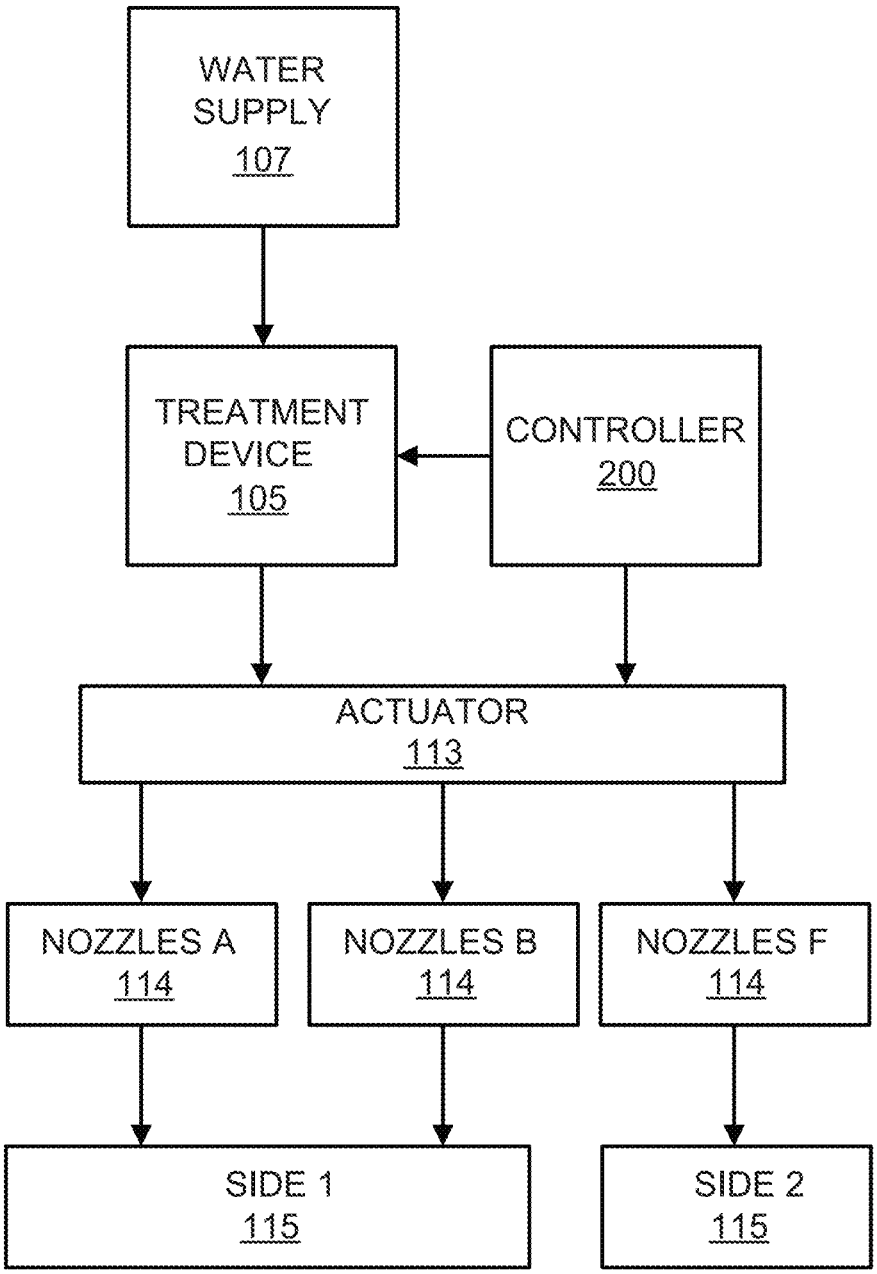
FIG. 6 illustrates a block diagram for the rinsing lavatory.

FIG. 6 illustrates a block diagram for the rinsing lavatory 100 including a water supply 107, a water treatment device 105, a controller 200, an actuator 113, and multiple sets of nozzles 114 associated with specific sides 115 (e.g., nozzle set A and nozzle set B for side 1; and nozzle set F for side 2, etc.). Additional, different, or fewer components may be included.

The controller 200 is configured to individually open each of the plurality of valves in a sequence for a sweeping motion or another pattern (e.g., the patterns of FIG. 2) of the rinsing water. The controller 200 may control solenoids through drive signals to open and close the valves The valves may be opened and closed in sequence to provide the pattern of effects. The actuator 113 may include any of the valve arrangements described herein. In one example, the controller 200 may be connected to 7 solenoid valves, including a first valve (set A) connected to nozzles at the sides of the basin 101, a second valve (set B) connected to nozzles on the faucet side of the basin 101, and four valves (sets C, D, E and F) for respective sections of nozzles at the rear of the basin. An example sequence may activate the solenoids in the order of set A, set B, set C, set D, set E, set F, set E, set D, set C as an example.

The actuator 113 may include a motor configured to drive a shuttle 117 associated with the at least one tube and configured to open the plurality of valves in a sequence for a sweeping motion of the rinsing water. For example, a worm gear 118 may be coupled to the shuttle 117 and driven by the motor. The worm gear 118 drives the shuttle 117 back and forth across the side of the basin 101. The shuttle 117 selectively blocks and opens individual nozzles to create the sweeping motion or other pattern of water down the side of the basin 101.

The actuator 113 may include one or more fluidic oscillators. Fluidic oscillators are passive (i.e., no power source is required). Through the supply line pressure only, the fluidic oscillators may provide an oscillating motion to water dispensed by the water delivery system 111.

A fluidic oscillator may include one or more fluidic modules and embodiments include two, three, four, or any number of fluidic modules interconnected through fluid pathways or through overlapping feedback paths. A single fluidic module may constitute a fluidic device and thus the term fluidic module may be used to describe one fluidic oscillator in a device having multiple fluidic oscillators. The fluidic oscillators may be mounted between the basin 101 and the countertop 102 and pointed towards the respective sides of the basin 101. The fluidic oscillators may be pointed substantially parallel to the respective sides of the basin 101. Other internal components of the fluidic device module may include a passive passage such as a diffuser, a feedback channel, an amplifier, or a diverter. The fluid oscillator may include one or more feedback channels, a mixing chamber, and an outlet that cause a fan output water flow to oscillate, fluctuate, or pulsate across a predetermined angle range. The repeating pattern of water includes a back and forth pattern about the vertical direction or in parallel to the slope of the basin 101.

The fluidic oscillator may be configured to switch the flow between two different flow channels (e.g., a bi-stable fluidic oscillator) or a direction of the flow (e.g., a mono-stable fluidic oscillator), and a flow restrictor configured to control timing of flow delivery to one or more channels or openings. The fluidic oscillator uses the coanda effect (e.g., the tendency of a fluid to remain attached to a curved or convex surface) to facilitate flow switching between the outlets. Among other benefits, the geometry of the channels in the fluidic oscillator allows timing and switching functions to be performed without moving parts and without a power source.

The water treatment device 105 may include a water tank for water that has been treated. In this case, a pump may provide the treated water to the supply lines 112. Alternatively, the additive or treatment may be added in line within the water treatment device 105 as the water is supplied under line pressure.

The water treatment device 105 may include an ozone generator. The controller 200 may send commands to turn the ozone generator on and off. The controller 200 may send commands for a level of ozone the ozone generator or a metering device connected to the ozone generator. Ozone, or trioxide or $O_3$, is an inorganic molecule and reactive gas. It may be pale blue in color and present a distinctive odor. It is an allotrope of oxygen and less stable than oxygen. Ozone may be formed naturally in the atmosphere by reaction with ultraviolet light from the sun and electrical discharges in the atmosphere. Ozonated water that is output from the water treatment device 105 is a powerful disinfectant that may be used to clean and/or disinfect the sides of the basin 101.

Ozone may be formed by the water treatment device 105 using a variety of techniques, including corona discharge, ultraviolet light, cold plasma, and other techniques. Any of these devices may be operated by the controller 200. For example, a corona charger may be configured to accumulate electric charge from a power source and apply the electric charge to air from an air source. In corona discharge, a corona discharge tube or an ozone plate is used. For example, a high voltage may be applied to an electrode in discharge tube or on the ozone plate. A corona discharge is an electrical discharge caused by the ionization of air surrounding the conductor carrying the high voltage. The air around the conductor undergoes an electrical breakdown to become conductive (e.g., temporarily) so that charge can leak off of the conductor and into the air. A corona occurs at locations where the strength of the electric field (potential gradient) around a conductor exceeds the dielectric strength of the air.

The ozone generator may use an air source, which may include only ambient air. The air may be provided under stored pressure or a differential pressure in the ozone generator. Ambient air may correspond to ozone production in a predetermined concentration range (e.g., 3-6%). Alternatively, an oxygen concentrator may be used to increase the concentration of oxygen in the air source. Pure oxygen may be used.

In another technique, ozone may be produced by ultraviolet light. Such an ozone generator includes a light source that generates a narrow-band ultraviolet light. The narrow-band ultraviolet light may be less than the spectrum of light produced by the sun. Ultraviolet light may produce ozone at a lower concentration (e.g., 1%) than corona techniques. Ultraviolet light ozone generates may exclude both air dryers and oxygen concentrators.

In another technique, ozone may be produced by cold plasma. Such an ozone generator includes a dielectric barrier discharge configured to generate plasma. Pure oxygen gas is supplied to the plasma and the oxygen molecules are split into single atoms, which recombine into groups of three, forming ozone, or $O_3$. Cold plasma techniques may produce high concentrations of ozone (e.g., 5% or greater) using a small amount of space.

In another technique, an electrolytic ozone generator produces ozone by splitting water molecules. Such an ozone generator includes a water electrolysis device that splits water molecules into $H_2$, $O_2$, and $O_3$. The hydrogen gas, $H_2$, may be removed to leave oxygen and ozone as the only products of the reaction. Electrolytic ozone generation may produce at higher concentrations (20-30%) than the corona discharge technique. The electrolytic techniques may also avoid nitrogen gases.

The water treatment device 105 may include an electrolyzed water generator. Electrolyzed water may be referred to as electrolyzed oxidizing water, electro-activated water, or electro-chemically activated water solution. Electrolyzed water may be generated by the electrolysis of water (e.g., ordinary water or tap water) with dissolved sodium chloride therein. The electrolysis may produce hypochlorous acid and sodium hydroxide. The electrolysis may include apply a direct current (DC) power source connected to multiple electrodes plates constructed from electroconductive material such as metal. An electrolyzed water reactor may perform electrolysis within the water treatment device 105 via a cathode and anode. The water treatment device 105 may include a separate housing that defines the reactor and includes an anode compartment for the anode and a cathode compartment for the cathode, which may be separated by a porous partition. In the anode compartment, a cleaning solution (alkaline) is produced, and in the cathode compartment, a sanitizing solution (acidic) is produced.

As a more specific example, at the cathode, hydrogen gas and hydroxide ions may be produced. At the anode, chloride ions may be oxidized into elemental chlorine. Near the cathode, the resulting alkaline solution is corrosive, and near the anode the solution includes sodium hydroxide. A sanitizing agent may be produced when hypochlorous acid without elemental chlorine is formed at around neutral pH. A neutralizing agent (e.g., vinegar) may be added to reach a target pH range.

The controller 200 is configured to turn on and off an electric current to the cathode and/or the anode. The controller 200 may provide a charge or bias to the cathode to generate the electric current between the cathode and the anode. The controller 200 may operate a valve to add the neutralizing agent to the reactor from a neutralizing agent compartment. The sanitizing solution may be an example disinfectant provided to the basin 101.

The controller 200 may send commands to any of these water treatment devices 105. For example, the commands may initiate the generation of the additive. The commands may be triggered by a time schedule (e.g., once every predetermined time period or at certain times of day). The commands may be triggered by flow in the water supply 107. The controller 200 may send a command to the water treatment device to generate the additive in response to a user input. For example, the controller 200 may operate the water treatment device 105 for a predetermined time after the user input is triggered.

In some embodiments, the user input may be a sensor (e.g., a proximity sensor) and the rinse cycle may be automatically initiated (e.g., by a controller) based on sensor data received from the sensor. The controller 200 may also receive sensor data as feedback for one or more conditions of the basin 101. For example, an image sensor may indicate when foreign material (e.g., dirt, toothpaste, trimmings, shaving cream, etc.) is present in the basin 101.

The water treatment device 105 provides the water through supply lines 112 to an actuator 113, which regulates the flow of the water to the nozzles 114. In some examples, water flows through the actuator 113 and in other examples, the actuator 113 impacts the flow of water to the nozzles 114. In one embodiment, the actuator 113 includes an inline turbine in the at least one tube configured to pump the rinsing water to the first side of the basin or the second side of the basin.

Figure 7:
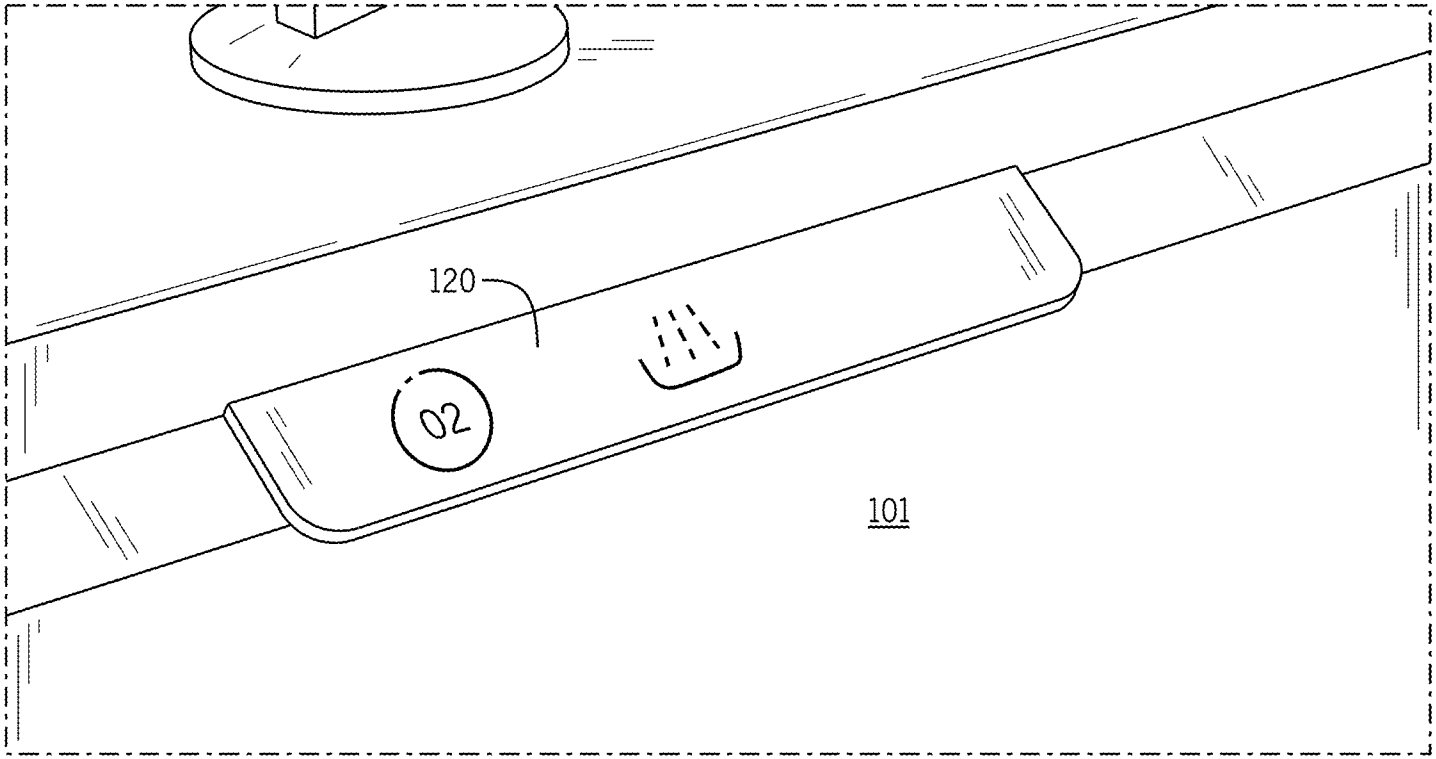
FIG. 7 illustrates an example input device for the rinsing lavatory.

FIG. 7 illustrates another example input device 120 for the rinsing lavatory. The input device 120 may include multiple buttons including a rinse cycle button and a timer button. The rinse cycle button may cause the controller 200 to start the generation of the additive and the rinse pattern on one or more sides of the basin. The timer button may be pressed a number of times, or held down for a time period, to set the duration of the rinse cycle. In another example, the rinse cycle button may be repeatedly depressed to set the duration of the rinse cycle. A sequence button may be used to select the number of sides to be rinsed, a specific side or sides to be rinsed, or a sequence of sides to be rinsed. A pattern button may be used to select a pattern for the rinse cycles. Example rinse cycles may include a waterfall, a sweeping pattern, a discontinuous pattern, an oscillator, or a combined oscillator and waterfall.

Figure 8:
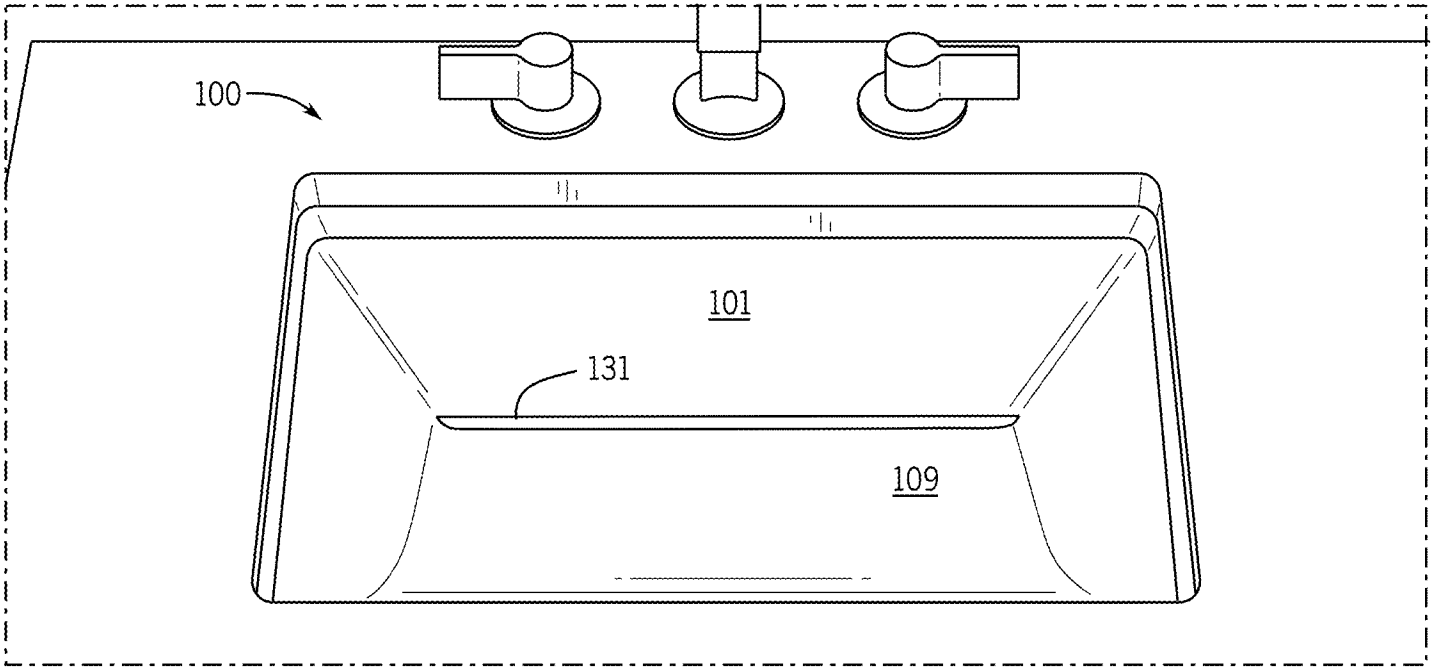
FIG. 8 illustrates a top view for the rinsing lavatory.

FIG. 8 illustrates a top view of the rinsing lavatory 100. The rinsing lavatory 100 may include at least one a curved and sloped surface 109 on the first side of the basin. A slot drain 131 extends across the second side of the basin 101. The basin 101 may include a glaze over the vitreous that aids in the water rinsing the foreign materials from the sloped surface 109 to the slot drain 131.

Figure 9:
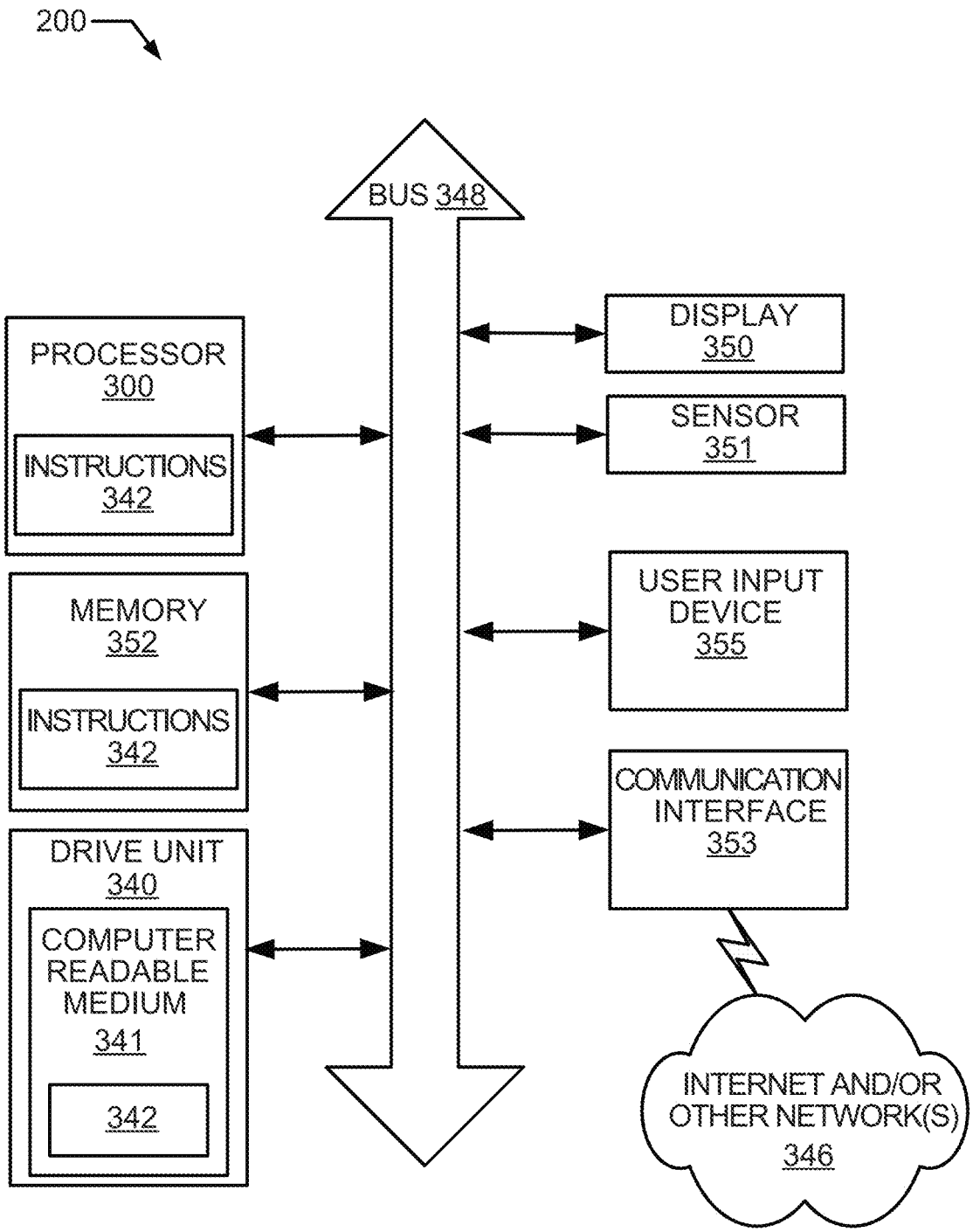
FIG. 9 illustrates an example controller for any of the disclosed embodiments.

FIG. 9 illustrates an example controller for any of the disclosed embodiments. The controller 200 may include a processor 300, a memory 352, and a communication interface 353 for interfacing with devices or to the internet and/or other networks 346. In addition to the communication interface 353, a sensor interface may be configured to receive data from the sensors described herein or data from any source. The controller 200 may include an integrated display 350, speaker 351, or other output devices. The components of the control system may communicate using bus 348. The control system may be connected to a workstation or another external device (e.g., control panel) and/or a database for receiving user inputs, system characteristics, and any of the values described herein.

Figure 10:
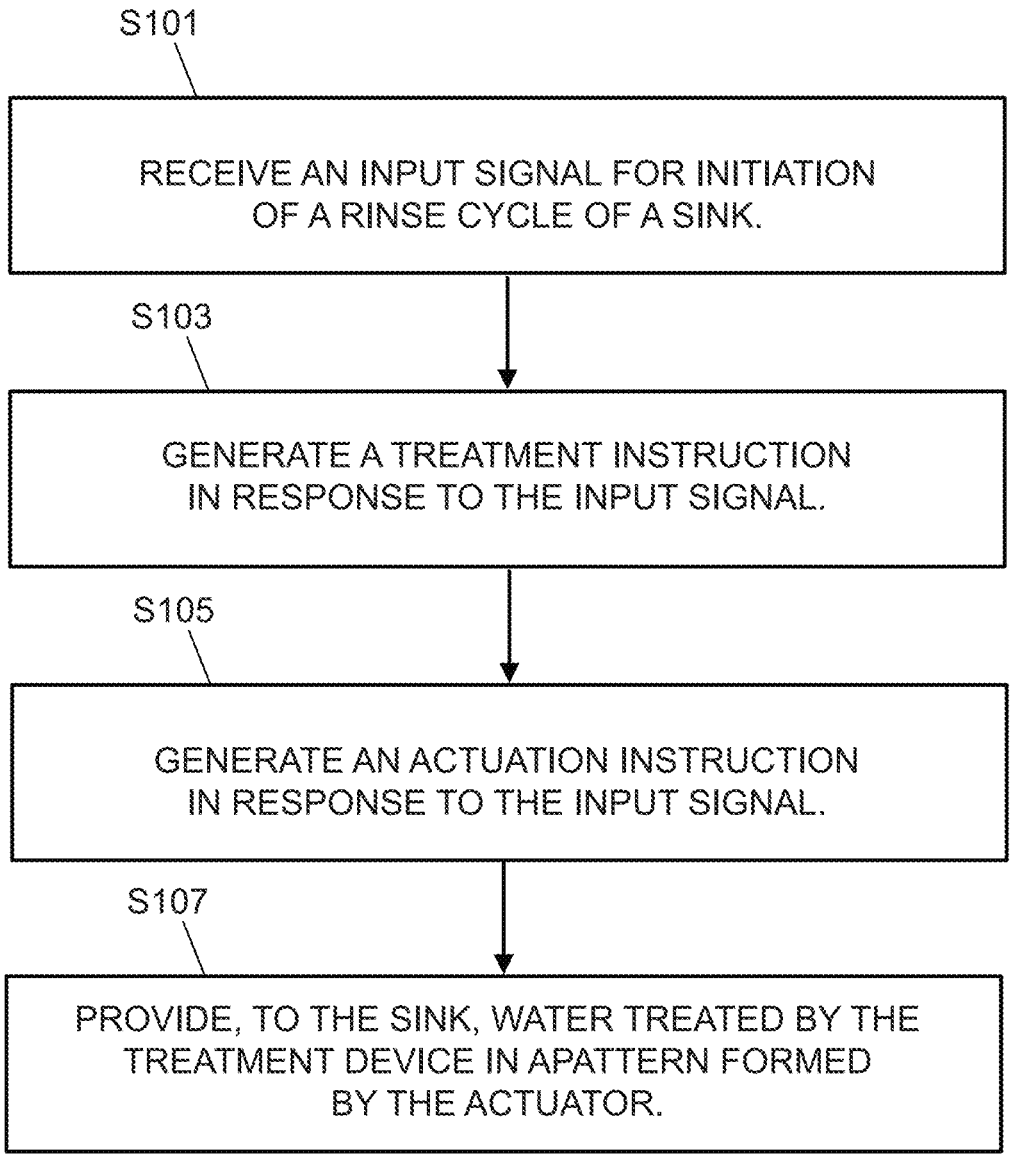
FIG. 10 illustrates an example flow chart for the controller of FIG. 9.

FIG. 10 illustrates an example flow chart for the operation of the flow detection device. Additional, different, or fewer acts may be performed.

At act S101, the processor 300 receives an input signal for initiation of a rinse cycle. The input signal may be automatic. For example, the input signal may depend on a timer implemented by the processor 300 such that the rinse cycle begins at a predetermined time. In another example, the input signal may be in response to a sensor. The sensor may detect the presence of a user or the absence of the user. That is, the sensor may detect when the user leaves the basin 101 so that the basin 101 is rinsed in response to the user leaving the basin. The sensor may detect a particular gesture (e.g., hand wave). Different hand wave may correspond to different rinsing cycles. The sensor may detect the type of usage prior to the rinse cycle (e.g., when brushing teeth is detected, a first rinse cycle or pattern is used, and when hand washing is detected, a second rinse cycle or pattern is used). The type of usage may also be determined based on the temperature of the water (e.g., as determined by a valve sensor or a temperature sensor), a duration of the usage of the water (e.g., as determined by a flow sensor), or the motion of the user.

At act S103, the processor 300 generates a treatment instruction for a treatment device. The treatment instruction may also be dependent of the detected presence of the user or the type of usage prior to the rinse cycle. When a first usage is detected a first treatment instruction is provided, and when a second usage is detected, a second treatment is provided.

At act S105, the processor 300 generates an actuation instruction for an actuator. The actuation instruction may specify a sequence of valves and one or more timings for each of the valves or between the sequence of valves. At act S107, the actuator provides, to the lavatory, water treated by the treatment device in a pattern formed by the actuator. The actuation instruction may specify an oscillation pattern, a waterfall pattern, a discontinuous pattern, a sweep pattern, or any combination or sequence of these patterns.

Optionally, the control system may include an input device 355 and/or a sensing circuit 356 in communication with any of the sensors. The sensing circuit receives sensor measurements from sensors as described above. The input device may include any of the user inputs such as buttons, touchscreen, a keyboard, a microphone for voice inputs, a camera for gesture inputs, and/or another mechanism.

Optionally, the control system may include a drive unit 340 for receiving and reading non-transitory computer media 341 having instructions 342. Additional, different, or fewer components may be included. The processor 300 is configured to perform instructions 342 stored in memory 352 for executing the algorithms described herein. A display 350 may be an indicator or other screen output device. The display 350 may be combined with the user input device 355.

Processor 300 may be a general purpose or specific purpose processor, an application specific integrated circuit (ASIC), one or more programmable logic controllers (PLCs), one or more field programmable gate arrays (FPGAs), a group of processing components, or other suitable processing components. Processor 300 is configured to execute computer code or instructions stored in memory 352 or received from other computer readable media (e.g., embedded flash memory, local hard disk storage, local ROM, network storage, a remote server, etc.). The processor 300 may be a single device or combinations of devices, such as associated with a network, distributed processing, or cloud computing.

Memory 352 may include one or more devices (e.g., memory units, memory devices, storage devices, etc.) for storing data and/or computer code for completing and/or facilitating the various processes described in the present disclosure. Memory 352 may include random access memory (RAM), read-only memory (ROM), hard drive storage, temporary storage, non-volatile memory, flash memory, optical memory, or any other suitable memory for storing software objects and/or computer instructions. Memory 352 may include database components, object code components, script components, or any other type of information structure for supporting the various activities and information structures described in the present disclosure. Memory 352 may be communicably connected to processor 300 via a processing circuit and may include computer code for executing (e.g., by processor 300) one or more processes described herein. For example, the memory 352 may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface 353 may include any operable connection. An operable connection may be one in which signals, physical communications, and/or logical communications may be sent and/or received. An operable connection may include a physical interface, an electrical interface, and/or a data interface. The communication interface 353 may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory 352) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

We claim:

1. A rinsing lavatory comprising:

a basin having at least a first side and a second side;

at least one tube connecting a water supply to a first plurality of nozzles on the first side of the basin and a second plurality of nozzles on a second side of the basin;

a water treatment device between the water supply and the at least one tube;

at least one valve configured to open the first plurality of nozzles or the second plurality of nozzles to provide rinsing water to the first side of the basin or the second side of the basin from the water treatment device through the at least one tube in response to an input signal; and a motor configured to drive a shuttle associated with the at least one tube and configured to open the at least one valve in a sequence for a sweeping motion of the rinsing water.

2. The rinsing lavatory of claim 1, wherein the at least one tube includes a first tube connected to a first plurality of valves and a second tube connected to a second plurality of valves.

3. The rinsing lavatory of claim 1, wherein the water treatment device includes an electrolyzed water generator.

4. The rinsing lavatory of claim 1, wherein the water treatment device add a chemical to the water supply.

5. The rinsing lavatory of claim 1, wherein the water treatment device includes a venturi configured to induct a treatment additive into the water supply.

6. The rinsing lavatory of claim 1, further comprising:

a user input configured to trigger the input signal.

7. The rinsing lavatory of claim 1, wherein the at least one valve includes a plurality of valves for the first plurality of nozzles.

8. The rinsing lavatory of claim 7, further comprising:

a controller configured to individually open each of the plurality of valves in a sequence for a sweeping motion of the rinsing water.

9. The rinsing lavatory of claim 1, further comprising:

a worm gear coupled to the shuttle and driven by the motor.

10. The rinsing lavatory of claim 1, wherein the basin is polygonal.

11. The rinsing lavatory of claim 1, wherein the basin is rectangular.

12. The rinsing lavatory of claim 1, further comprising:

a curved and sloped surface on the first side of the basin.

13. The rinsing lavatory of claim 1, further comprising:

a slot drain extending across the second side of the basin.

14. The rinsing lavatory of claim 1, wherein the at least one tube connects the water supply to a third plurality of nozzles on a third side of the basin and a fourth plurality of nozzles on a fourth side of the basin.

15. The rinsing lavatory of claim 1, wherein the first plurality of nozzles or the second plurality of nozzles includes a fluidic oscillator.

16. A rinsing lavatory comprising:

a basin;

at least one tube connecting a water supply to a plurality of nozzles;

a water treatment device between the water supply and the at least one tube; and a motor configured to drive a shuttle associated with the at least one tube and configured to open at least one valve in a sequence for a sweeping motion of water.

17. A method for rinsing a lavatory, the method comprising:

receiving an input signal for initiation of a rinse cycle;

generating a treatment instruction for a treatment device;

generating an actuation instruction for a motor configured to drive a shuttle and configured to open at least one valve; and providing, to the lavatory, water treated by the treatment device in a pattern formed by the motor and the shuttle.

18. The method of claim 17, wherein the treatment device is configured to generate ozone or electrolyzed water.

* * * * *